US011130033B2

(12) United States Patent
Smith

(10) Patent No.: US 11,130,033 B2
(45) Date of Patent: Sep. 28, 2021

(54) RIM PADDING FOR BASKETBALL HOOPS

(71) Applicant: Joseph Evan Smith, Santa Clara, UT (US)

(72) Inventor: Joseph Evan Smith, Santa Clara, UT (US)

( * ) Notice: Subject to any disclaimer, the term of this patent is extended or adjusted under 35 U.S.C. 154(b) by 0 days.

(21) Appl. No.: 16/381,307

(22) Filed: Apr. 11, 2019

(65) Prior Publication Data

US 2019/0314697 A1 Oct. 17, 2019

Related U.S. Application Data

(60) Provisional application No. 62/658,815, filed on Apr. 17, 2018.

(51) Int. Cl.
*A63B 69/00* (2006.01)
*A63B 63/08* (2006.01)

(52) U.S. Cl.
CPC ..... *A63B 63/083* (2013.01); *A63B 2209/10* (2013.01)

(58) Field of Classification Search
CPC ..... A63B 63/083
USPC ..... 473/485, 487, 489
See application file for complete search history.

(56) References Cited

U.S. PATENT DOCUMENTS

| | | | | |
|---|---|---|---|---|
| 4,834,368 | A * | 5/1989 | Qualley | A63B 63/083 43/11 |
| 5,743,154 | A * | 4/1998 | Jacinth | B62D 1/06 74/558 |
| 6,935,966 | B2 * | 8/2005 | Kershaw | A63B 63/083 473/248 |
| 7,429,224 | B2 * | 9/2008 | Publicover | A63B 63/083 473/479 |
| 2015/0375075 | A1 * | 12/2015 | Smith | A63B 63/083 473/489 |
| 2019/0283791 | A1 * | 9/2019 | Strong | B62D 1/06 |

* cited by examiner

*Primary Examiner* — Raeann Gorden
(74) *Attorney, Agent, or Firm* — Gutwein Law; Greg Geiser

(57) ABSTRACT

A device for generally providing an unobtrusive and protective padded area for placement on a basketball hoop rim in a wrapped assembly. The device comprising a pad having a first side and a second side opposed the first side defining a thickness. The pad including a plurality of apertures having a size and spaced for the receipt of a net hook of the rim and at least one fastener configured to secure the device around the rim.

17 Claims, 8 Drawing Sheets

RIM PADDING FOR BASKETBALL HOOPS

CROSS REFERENCE TO RELATED APPLICATIONS

This application claims priority to U.S. Provisional Patent Application No. 62/658,815 filed 17 Apr. 2018 to the above-named inventor and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The invention relates generally to an unobtrusive pad configured for placement on the rim of a basketball hoop to protect a player from injury due to contacting the rim.

BACKGROUND

Within the sport of basketball, a player attempts to place a basketball into and through a hoop or rim, as it is commonly referred, with an attached net. The rim is typically constructed from a ⅝-inch diameter solid high tensile carbon steel rod that is shaped into the hoop having an inner diameter of eighteen (18) inches. The hoop is then generally welded to a bracket and a plate to position the hoop for mounting to a backboard in a perpendicular position.

During the game of basketball one of the most exciting events is the slam dunk, wherein a player will forcefully direct the basketball over and through the hoop. Often during this slam dunking process the players hands or arms will contact the solid surface of the rim. Understandably, this contact can result in injury.

Within the current marketplace there exist several mechanical assemblies configured to lower the height of the basketball hoop from its standard height of ten (10) feet to a height more accessible to smaller and younger players. Often this is done to allow these players an opportunity to slam dunk the basketball through the hoop. This lower height further increases the possibility of injury for younger and smaller players.

Currently, a small number of solutions are found within the prior art to generally protect a player from injury when contacting the basketball hoop. A first solution attempts to use a spring member affixed to the rim plate to allow the rim to flex downward or "breakaway" upon a downward force, but this solution fails to meet the needs of the market because the spring assembly only allows for movement in a single direction. An additional solution for safety within the game of basketball is the placement of padding around the backboard and pole of a basketball hoop, but this solution is similarly unable to meet the needs of the market because the padding does not protect a user from an injury caused by the rim. Still another solution places the protective solution on the onus of the player through the addition of tape or padding to the player's hands, but this solution also fails to meet market needs because this can come off due to sweat and/or wear and tear from playing.

SUMMARY OF THE INVENTION

It would be advantageous to have an apparatus that adhered to a basketball rim for generally protecting a player during use and gameplay. Furthermore, it would also be advantageous to have an apparatus that adhered around the net hooks and loops in a robust and removable assembly. Still further, it would be advantageous to have an apparatus that was flush with the rim and configured to not interfere with a shot or a slam dunk upon the hoop during use. Therefore, there currently exists a need in the market for an apparatus that is a padded device configured for placement on the rim of a basketball hoop in an unobtrusive manner.

The disclosure of the present invention advantageously fills the aforementioned deficiencies by providing a rim padding device for basketball hoops, which provides hand and arm protection for basketball players when slam dunking or otherwise contacting the rim during gameplay.

The device of the present disclosure is generally configured for universal usage on the rim portion of a basketball hoop. The device is configured to surround the rim portion of the hoop and utilizes a plurality of fasteners to secure the device to itself as it is wrapped around the rim. Accordingly, the device shape includes a plurality of slots dimensionally selected and placed to correspond to the hooks and loops on the rim to allow for placement of the net without interference and placement on the rim while the net is installed onto the rim without having to remove the net.

The fasteners of the device may be provided in alternate assemblies depending upon the preference of the user. Accordingly, the fastener may allow for reuse of the device, wherein it is generally selected from a hook and loop fastener type to allow the device to be removed and replaced for use. Alternately, the fastener may be provided in the form of an adhesive, wherein the device includes an embedded adhesive placed to adhere an opposed side of the device when wrapped.

The device of the present disclosure is generally comprised of resilient and durable material, such as, but not limited to a foam rubber, having a thickness to generally provide a padded surface. In the preferred embodiment of the present disclosure the device is constructed from an ethylene propylene diene monomer rubber ("EPDM") to provide resistance to ultra violet ("UV") rays and ozone when used in an exterior environment. Preferably, the device is provided in a range of thicknesses depending upon performance desired, with the range between 1/16 of an inch and ½ of an inch.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
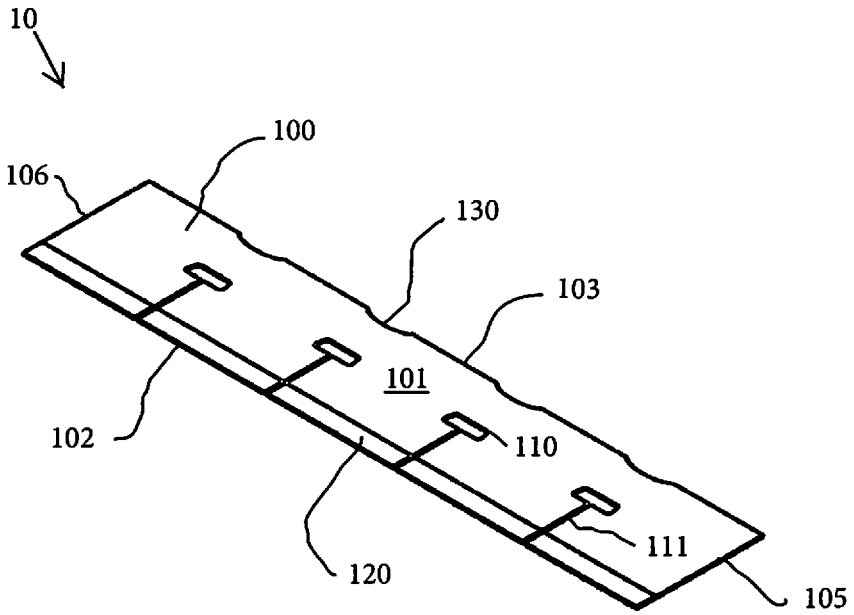
FIG. 1 shows a perspective view of the device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The present disclosure most generally provides a padded device configured specifically for placement on a rim of a basketball hoop in an unobtrusive manner to protect a user from injury due to contacting the rim.

Figure 2:
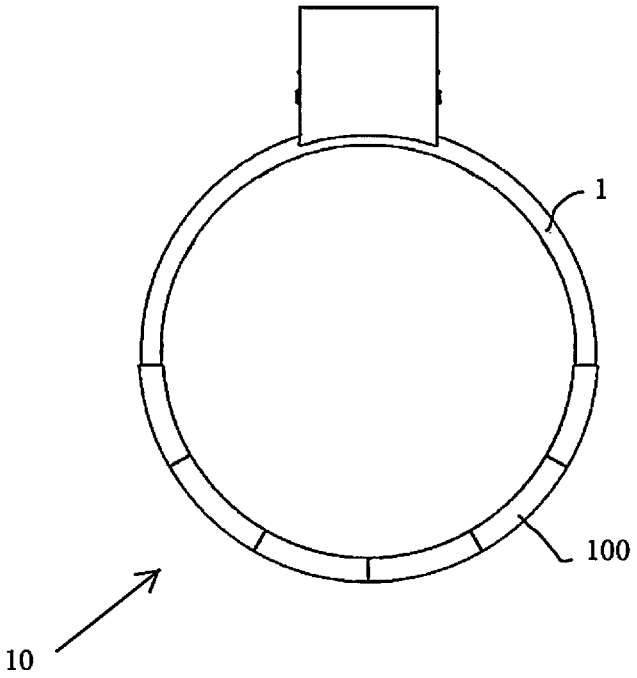
FIG. 2 shows the top of the device on a basketball rim, according to the present disclosure.
Figure 3:
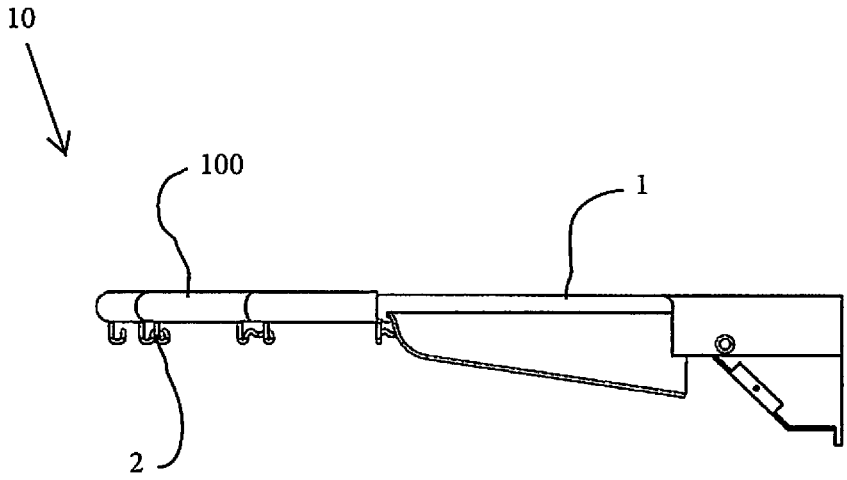
FIG. 3 shows the side of the device on a basketball rim, according to the present disclosure.
Figure 4:
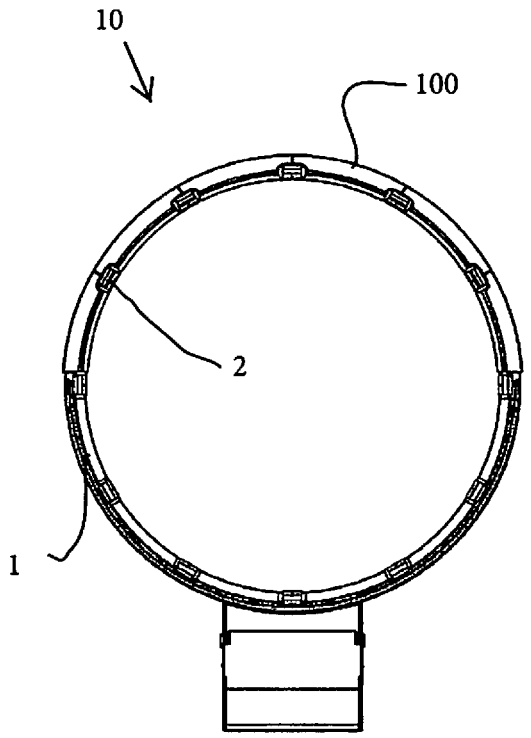
FIG. 4 shows the bottom of the device on a basketball rim, according to the present disclosure.
Figure 5:
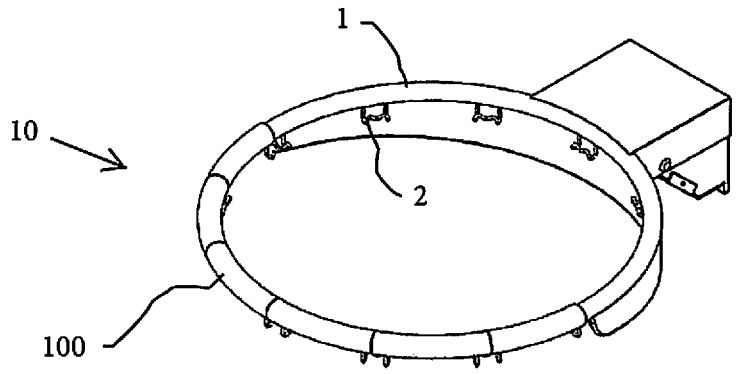
FIG. 5 shows a perspective view of the device on a basketball rim, according to the present disclosure.
Figure 6:
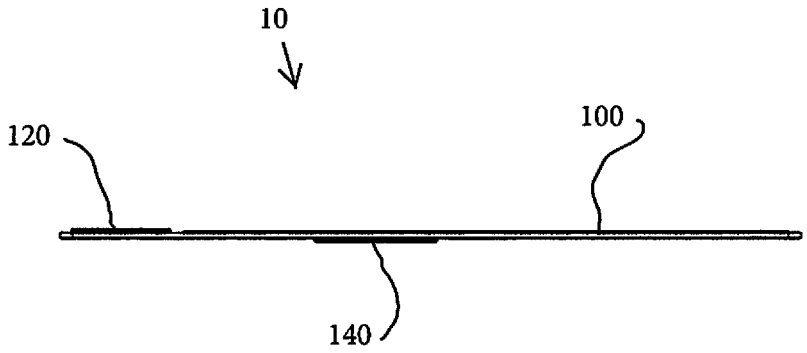
FIG. 6 shows the side of the device, according to the present disclosure.
Figure 7:
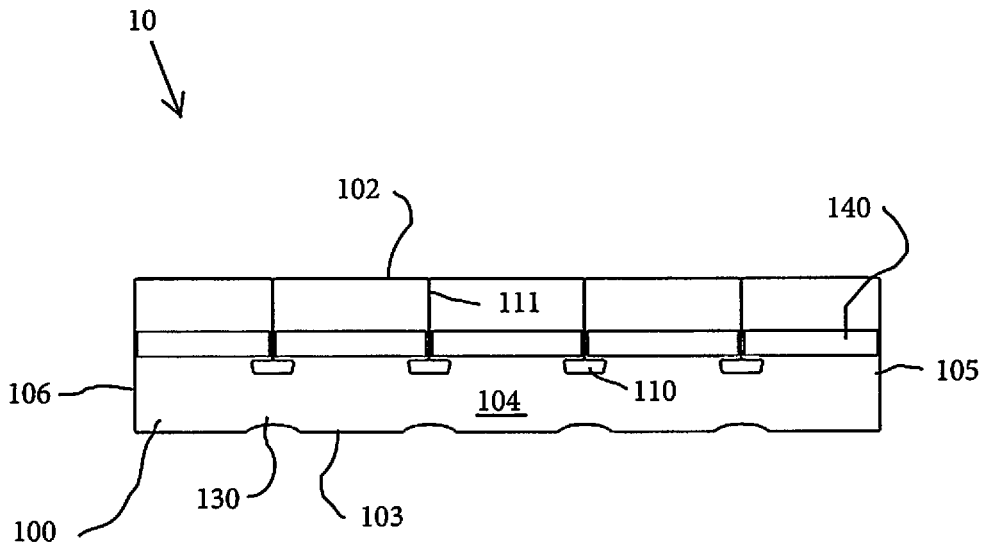
FIG. 7 shows the outside of the device, according to the present disclosure.
Figure 8:
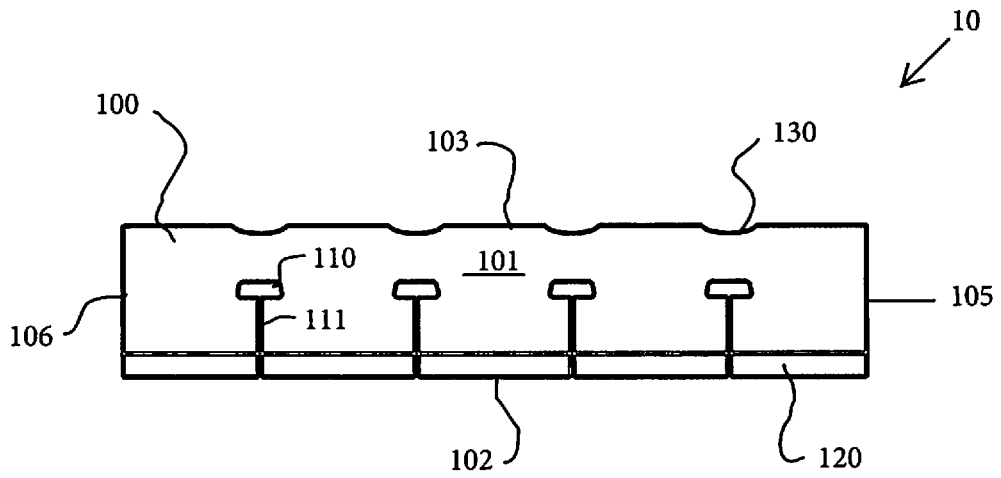
FIG. 8 shows an inside of the device, according to the present disclosure.

Referring now to the figures, FIGS. 1-8 show a rim 1 padding device configured for placement on a basketball hoop with the device generally referred to as device 10. The device 10 is configured to wrap around the rim of the basketball hoop to provide a protective surface in a generally unobtrusive manner. The device 10 is most generally comprised of a pad 100. The pad having a first side 101 opposed a second side 104, a first edge 102 opposite a second edge 103, and a first end 105 opposite a second end 106. A distance between the first side 101 and the second side 104 defining a thickness of the pad 100. A distance between the first edge 102 and the second edge 103 defining a width of the pad 100. A distance between the first end 105 and the second end 106 defining a length of the pad 100. Accordingly, the device 10 perimeter of the pad 100 defined by the first edge 102, the first end 105, the second edge 103, and the second end 106.

The device 10 including a plurality of apertures 110 through the pad 100 with each aperture 110 of the plurality of apertures 110 sized and spaced for receipt of a net hook 2 of the rim 1 the device 10 is installed upon. The apertures 110 generally positioned at a central position of the pad 100 and extending through the pad 100 from the first side 101 to the second side 104. The device further includes a plurality of slits 111 through the pad 100 with each slit 111 of the plurality of slits 111 coupled to a single aperture 110 of the plurality of apertures 110 at a middle position of each aperture 110 to allow for installation of the pad 100 in an unobtrusive manner.

The pad 100 of the device 10 is configured to be wrapped around the rim and secured to itself to maintain its position. In the preferred embodiment of the present disclosure, the first edge 102 of the first side 101 includes a first fastener 120 configured for engagement with a second fastener 140 on the second side 104. Preferably, the first fastener 120 and second fastener 140 are of the hook and loop variety, wherein the device 100 can be removably placed. Alternately, the first fastener 120 and the second fastener 140 can be an adhesive surface selected to allow for permanent, semi-permanent, or removable fastening. When this adhesive configuration for the device 10 is utilized, the first fastener 120 or the second fastener 140 can be eliminated, wherein a single fastener 120, 140 is adhered directly to the pad 100.

Preferably, the second fastener 140 is positioned adjacent to the plurality of apertures 110 on a side adjacent to the plurality of slits 111. Accordingly, the receipt of the first fastener 120 and second fastener 104 is desired to be adjacent to the net hook 2 of the rim 1 at an underside of the rim to maintain the unobtrusive nature of the device 10.

To further maintain the unobtrusive nature of the device 10, the pad 100 second edge 103 may include a plurality of recesses 130. Each recess 130 of the plurality of recesses 130 along the second edge 103 is aligned with a corresponding aperture 110 of the plurality of apertures 110. Each recess 130 of the plurality of recesses 130 generally arcuate in shape with the arc extending toward the first edge 102 into an interior of the pad 100. The plurality of recesses 130 generally configured for placement adjacent to the net hook 2 when installing the device 10 to maintain a straight edge during positioning of the device 10 on the rim.

The device 10 is configured for general placement along a front portion of the rim 1 at a position that is generally contacted by a user. Generally, to accommodate rim 1 construction, support techniques, and a standard net having twelve (12) net loops, including supporting brackets, the device 10 length is selected to extend approximately 180 degrees of the rim 1, wherein the device 10 encompasses five (5) net hooks 2 within the interior of the pad 100 and abuts additional net hooks 2 on the first end 105 and the second end 106. Although the length, defined as the distance between the first end 105 and the second end 106, is selected to encompass half of the circumference of the rim 1 (180 degrees), the length may be provided is several other dimensions to accommodate different rim 1 assemblies and brackets. Alternately, the device 10 may be provided in an extended length, wherein a user may cut the device 10 pad 100 to their own desired length for application on a given rim 1 for a given use.

The material of the device 10 and pad 100, in particular, is comprised of a resilient and durable material, such as, but not limited to a foam rubber, having a thickness selected to provide a protective surface. In the preferred embodiment of the present disclosure, the pad 100 material is an ethylene propylene diene monomer rubber ("EPDM") to provide resistance to ultra violet ("UV") rays and ozone when used in an exterior environment. Although EPDM is the preferred material for the pad 100, additional materials having similar properties may be utilized.

The device 10 may be provided in multiple embodiments to provide different levels of performance and protection. Generally, the various levels of protection and performance correlate to the thickness of the pad 100 of the device 10. Accordingly, the thickness of the pad 100, defined as the distance between the first side 101 and the second side 104, is selected from a range of 1/16 of an inch to 1/2 of an inch.

In use of the device 10, a user will generally select a given device 10 for application onto a given rim 1. The user will align the plurality of slits 111 and plurality of apertures 110 with the net hooks 2 of the rim 1 and wrap the device 10 around the rim 1. The user will secure the device 10 in place through engagement of either the first fastener 120, the second fastener 140, or both the first fastener 120 and the second fastener 140. The device 10 will then be secured in place where it can be utilized to protect players from injury.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A device configured for placement on a basketball hoop rim, a basketball hoop rim having a plurality of net hooks for securing a net, the device comprising:

a pad, the pad having a thickness configured to provide a protective surface including:

a plurality of apertures, each aperture of the plurality of apertures sized to be capable of receiving a net hook;

a plurality of slits, each slit of the plurality of slits coupled to a single aperture of the plurality of apertures; and at least one fastener, the at least one fastener configured for securing the pad onto itself, wherein the pad is wrapped around a basketball hoop rim during use.

2. The device as in claim 1 including a second fastener, the second fastener configured for coupling with the at least one fastener to secure the pad.

3. The device as in claim 2, wherein the at least one fastener and the second fastener are comprised of a hook and loop material.

4. The device as in claim 1, wherein the pad includes a length, the length selected to extend one hundred and eighty degrees around a basketball hoop rim the device is placed upon.

5. The device as in claim 1, wherein the thickness of the pad is selected from a range of one-sixteenth of an inch to one-half of an inch.

6. The device as in claim 1, wherein the device is constructed out of an ethylene propylene diene monomer rubber.

7. A device configured to provide a protective surface for placement on a basketball hoop rim having a plurality of net hooks spaced around a circumference of the rim to secure a net, t the device comprising:

a pad, the pad including:

a first side;

a second side, the second side opposed the first side, a distance between the first side and the second side defining a thickness of the pad;

a first edge;

a second edge, the second edge opposite the first edge, a distance between the first edge and the second edge defining a width of the pad;

a first end;

a second end, the second end opposite the first end, a distance between the first end and the second end defining a length of the pad, wherein the first edge, second edge, first end, and second end define a perimeter of the pad;

a plurality of apertures, the apertures extending from the first side to the second side and sized and spaced for receiving a net hook;

a plurality of slits, each slit of the plurality of slits coupled to a single aperture of the plurality of apertures; and at least one fastener, the at least one fastener configured for securing the pad onto itself around a basketball hoop rim.

8. The device as in claim 7 including a second fastener, the second fastener configured for coupling with the at least one fastener to secure the pad.

9. The device as in claim 8, wherein the at least one fastener is positioned on the first side and the second fastener is positioned on the second side.

10. The device as in claim 9, wherein the at least one fastener is positioned along the first edge and the second fastener is positioned adjacent to the plurality of apertures.

11. The device as in claim 7, wherein the at least one fastener and the second fastener are comprised of a hook and loop material.

12. The device as in claim 7, wherein the plurality of apertures is centrally positioned along the width of the pad.

13. The device as in claim 7, wherein the length is selected to extend one hundred and eighty degrees around a basketball hoop rim the device is placed upon.

14. The device as in claim 7, wherein the thickness of the pad is selected from a range of one-sixteenth of an inch to one-half of an inch.

15. The device as in claim 7, wherein the device is constructed out of an ethylene propylene diene monomer rubber.

16. A device configured to provide a protective surface for placement on a basketball hoop rim having a plurality of net hooks spaced around a circumference of the rim to secure a net, the device comprising:

a pad, the pad including:

a first side;

a second side, the second side opposed the first side, a distance between the first side and the second side defining a thickness of the pad;

a first edge;

a second edge, the second edge opposite the first edge, a distance between the first edge and the second edge defining a width of the pad;

a first end;

a second end, the second end opposite the first end, a distance between the first end and the second end defining a length of the pad, wherein the first edge, second edge, first end, and second end define a perimeter of the pad;

a plurality of apertures, the plurality of apertures centrally positioned along the width of the device, the plurality of apertures extending from the first side to the second side and sized and spaced to be capable of receiving a net hook;

a plurality of slits, each slit of the plurality of slits coupled to a single aperture of the plurality of apertures;

at least one fastener, the at least one fastener positioned on the first side, and;

a second fastener, the second fastener positioned on the second side adjacent to the plurality of apertures, wherein the at least one first fastener is configured for coupling the second fastener for securing the pad onto itself and around a basketball hoop rim.

17. The device as in claim 16, wherein the at least one fastener and the second fastener are comprised of a hook and loop material.

* * * * *